United States Patent [19]

Fontaine et al.

[11] 4,348,662

[45] Sep. 7, 1982

[54] CAPACITY SENSING INTRUSION ALARM APPARATUS

[75] Inventors: William G. Fontaine, Pompano Beach; Willes W. Reeder, Fort Lauderdale, both of Fla.

[73] Assignee: Sleep Safe, Limited, Pompano Beach, Fla.

[21] Appl. No.: 210,056

[22] Filed: Nov. 24, 1980

[51] Int. Cl.[3] ..... G08B 13/26; G08B 17/10; G08B 19/00

[52] U.S. Cl. ..... 340/562; 340/521; 340/546

[58] Field of Search ..... 340/562, 521, 546

[56] References Cited

U.S. PATENT DOCUMENTS

| | | | |
|---|---|---|---|
| 3,254,213 | 5/1966 | Atkins et al. | 331/111 |
| 3,465,325 | 9/1969 | Goldfarb et al. | 340/258 |
| 3,510,677 | 5/1970 | Lister | 340/562 |
| 3,623,063 | 11/1971 | Fontaine | 340/274 |
| 3,878,539 | 4/1975 | Gooding | 340/521 |
| 4,091,371 | 5/1978 | Mason, Jr. et al. | 340/562 |
| 4,100,539 | 7/1978 | Stahl et al. | 340/546 |
| 4,173,755 | 11/1979 | Butler | 340/562 |
| 4,222,045 | 9/1980 | Cholin | 340/562 |
| 4,258,359 | 3/1981 | McLamb | 340/521 |

*Primary Examiner*—Glen R. Swann, III

*Attorney, Agent, or Firm*—Oltman and Flynn

[57] ABSTRACT

This intrusion alarm apparatus has a housing suspended from a metal doorknob such that the housing is tilted when the doorknob is turned. A 100 kHz. oscillator is synchronized with a single shot which produces narrower pulses than the oscillator. An exclusive OR circuit subtracts the single shot pulses from the oscillator pulses. When the door is of wood or other electrically non-conductive material, the body capacitance of a person touching the doorknob increases the width of the pulses produced by the single shot and this change is reflected through the exclusive OR circuit, an integrator, a level detector and a flip-flop to turn on an audible alarm device. When the door itself is metallic, a selector switch can disable the alarm device from responding to the body capacitance of a person touching the doorknob, in which case the tilt switch in the housing will turn on the alarm device when the doorknob is turned. The alarm apparatus also contains a thermostatic switch and a smoke detector for turning on the alarm device in case of fire.

19 Claims, 3 Drawing Figures

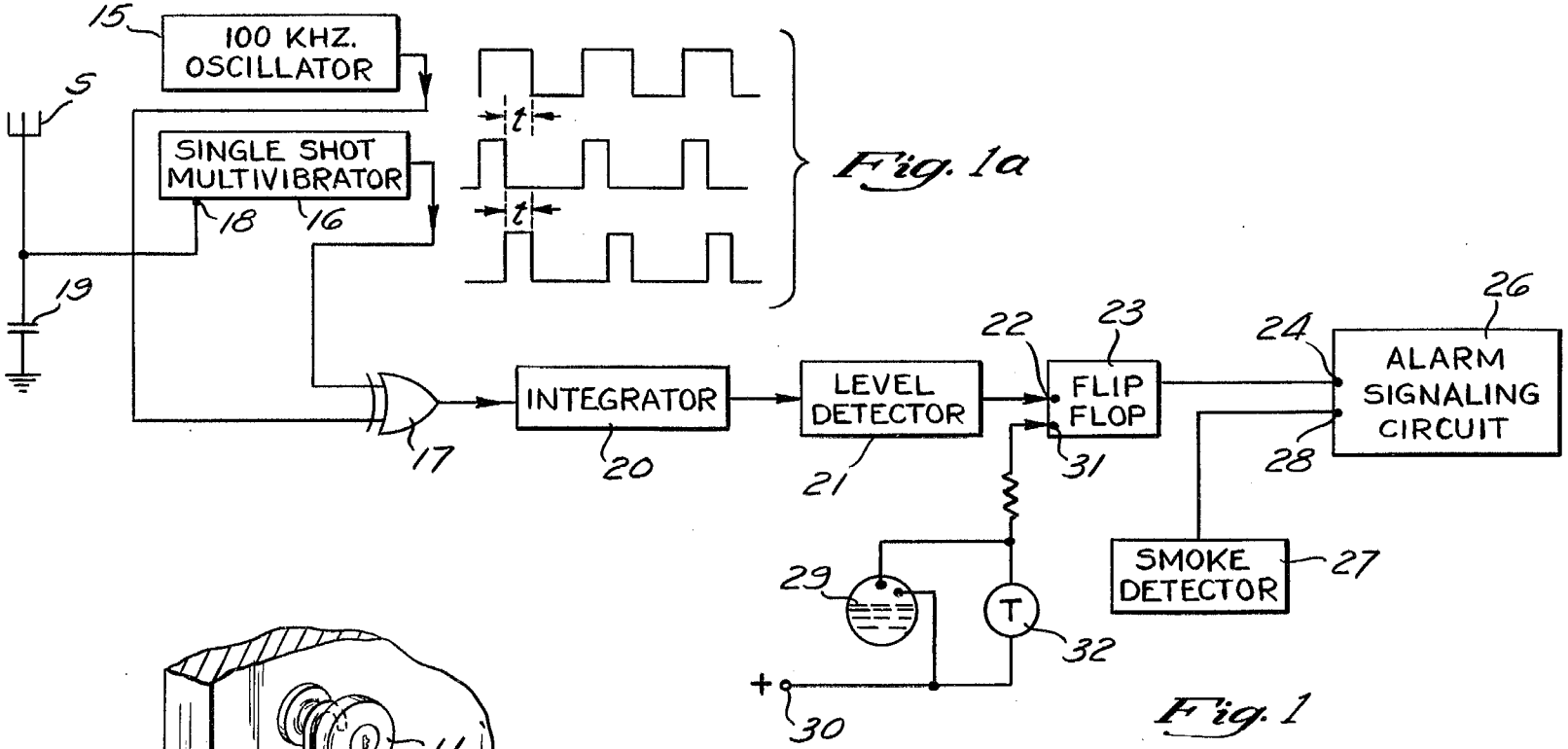
Fig. 1
Fig. 1a
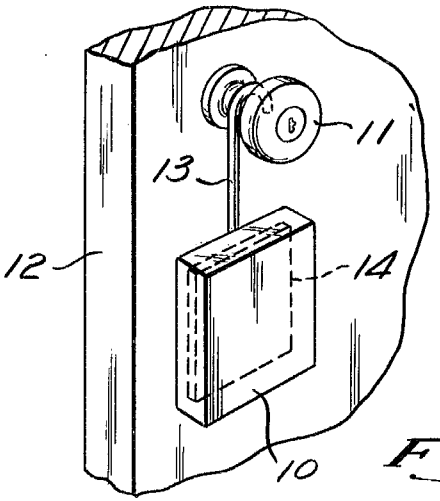
Fig. 2

CAPACITY SENSING INTRUSION ALARM APPARATUS

SUMMARY OF THE INVENTION

This invention relates to an intrusion alarm apparatus of the type which is hung on the inside doorknob of a door to sense the presence of a would-be intruder outside.

An important object of this invention is to provide such an intrusion alarm apparatus having an electrical circuit which operates in response to the body capacitance of a would-be intruder touching the outside doorknob and is made up largely of highly reliable, relatively low cost integrated circuit chips.

Another object of this invention is to provide such an intrusion alarm apparatus having a battery-powered oscillator operating at a relatively low frequency (e.g., 100 kHz.) and provided on an integrated circuit chip without any inductors.

Another object of this invention is to provide an intrusion alarm apparatus which produces a control signal which changes when there is a change in the difference in width between the output pulses from an oscillator and the narrower output pulses from a single shot which is synchronized with the oscillator, the single shot being coupled to the doorknob such that the width of its pulses is changed by the body capacitance of a person touching the doorknob.

Another object of this invention is to provide a novel intrusion alarm apparatus for use on a doorknob and having provision for responding to the body capacitance of a person touching the doorknob, in the case of a non-metallic door, or for responding to the turning of the doorknob, in the case of a metal door.

Another object of this invention is to provide a novel intrustion alarm apparatus which includes means for signalling an alarm in the event of a fire in the premises protected by the alarm apparatus.

Further objects and advantages of this invention will be apparent from the following detailed description of a presently-preferred embodiment shown schematically in the accompanying drawings.

DESCRIPTION OF THE DRAWINGS

FIG. 1 is a block diagram of an alarm apparatus in accordance with the present invention;

FIG. 1*a* shows the wave forms of the outputs from the oscillator, the single-shot and the exclusive OR circuit in FIG. 1;

FIG. 2 is a perspective view showing how the present alarm apparatus is hung on the inside doorknob of a door, with a balancer plate in the alarm apparatus shown in phantom.

Figure 3:
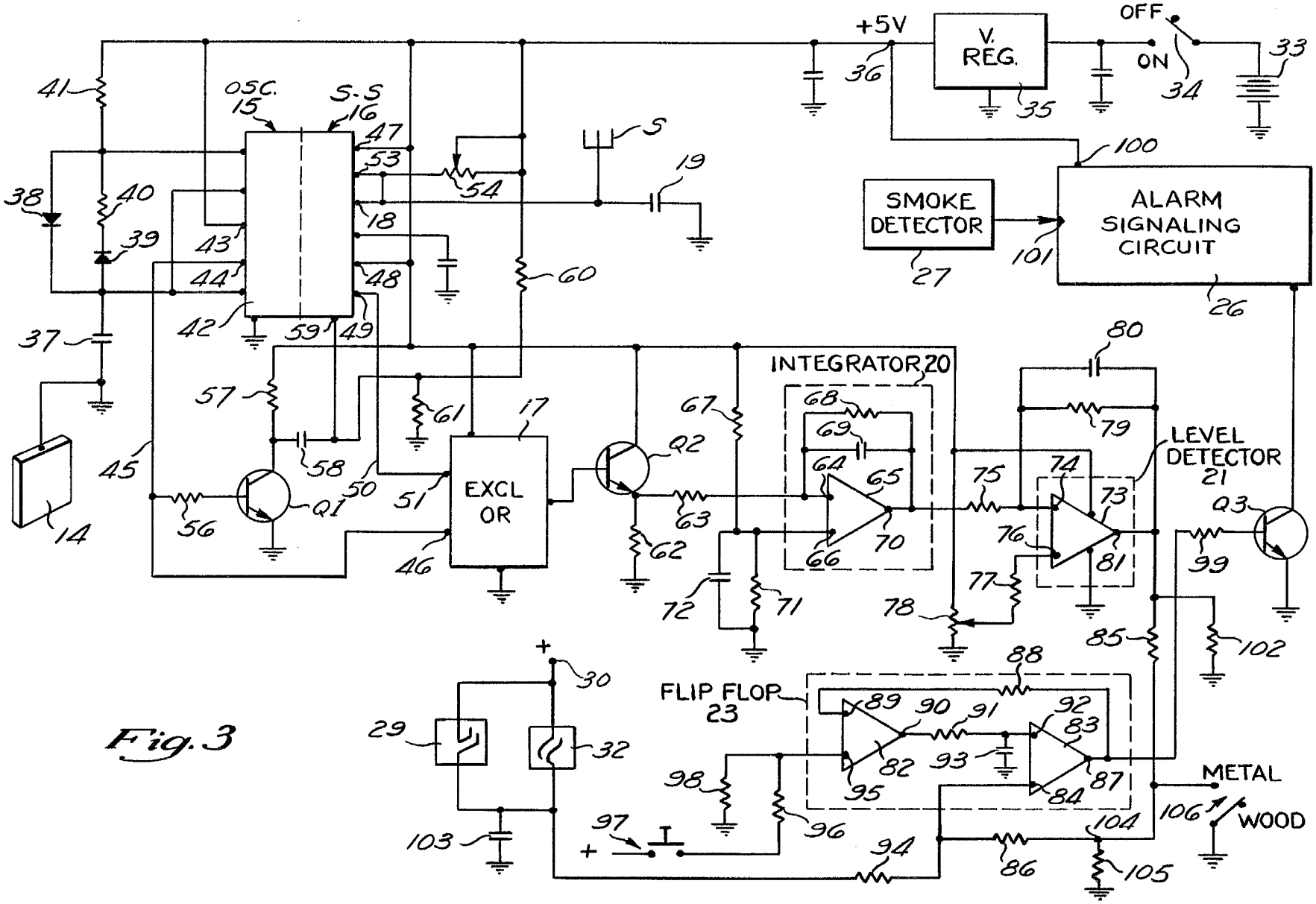
FIG. 3 is a more detailed circuit diagram of the present invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Referring to FIG. 2, the present alarm apparatus has a relatively small housing 10 which is suspended from an electrically conductive doorknob 11 on the inside of a door 12 leading into the premises which are to be protected from an unauthorized intruder, such as a burglar. The suspension means preferably takes the form of a hook-shaped handle 13 of electrically conductive material, as shown schematically. The suspension hook for the housing 10 preferably has a spring clip or some other frictional attachment means for mounting it on the doorknob in such a manner that rotation of the doorknob will tilt the housing 10. In addition to electrical circuitry described in detail hereinafter, the housing 10 contains an electrically conductive, broad area, planar balancer plate 14 which extends across the back of the housing 10 in close proximity to the door, as disclosed in U.S. Pat. No. 3,623,013 of John V. Fontaine. This balancer plate 14 provides a reference potential which for convenience is shown as a ground in FIG. 3. It is to be understood that this is an internal "ground" in the alarm apparatus, and it usually will not be exactly at ground potential.

Referring to FIG. 1, the intrusion alarm circuitry comprises an oscillator 15 which produces a first series of output pulses in the form of a 100 kHz. square wave as shown in the top line of FIG. 1*a* (amplitude vs. time). A single shot circuit 16 produces a square wave at the same pulse repetition rate as, but of narrower width (i.e., shorter time duration) than, the square wave produced by oscillator 15. The output from the single shot 16 is shown on the second line of FIG. 1*a*. Each output pulse from the single shot 16 begins substantially simultaneously with the beginning of the output pulse from the oscillator 15 in each cycle. The output from the single shot 16 constitutes a second series of pulses which are synchronized with the pulses of the first series. The outputs from the 100 kHz. oscillator 15 and the single shot 16 are applied to respective input terminals of an exclusive OR gate 17 of conventional design, which produces an output signal as shown on the bottom line of FIG. 1*a*. The width of each square wave output pulse from the exclusive OR gate 17 is proportional to the difference between the widths (i.e., durations) of the oscillator and single shot pulses. That is, the wider the pulses from the single shot 16, the narrower will be the pulses from the exclusive OR gate 17, and vice versa.

The width (i.e., time duration) of each pulse from the single shot 16 is determined by the capacitance appearing between a control terminal 18 of the single shot and the "ground" provided by balancer plate 14. This capacitance is normally determined entirely by a fixed capacitor 19, which is connected between the single shot terminal 18 and the balancer plate 14. The hook 13 (FIG. 1) or other conductive suspension for the alarm apparatus, the metal doorknob (not shown) on the outside of the door, and the metallic parts connecting the outside doorknob conductively to the hook 13 together constitute a sensor shown schematically at S in FIG. 1. This sensor is connected to the single shot terminal 18. When a person touches or closely approaches the doorknob on the outside of the door, that person's body capacitance is applied to terminal 18 and increases the width of each output pulse from the single shot 16.

The output from the exclusive OR gate 17 is applied to the input of an integrator 20 whose output signal is applied to the input of a level detector 21. The output of the level detector is applied to one input terminal 22 of a flip-flop 23. The output of the flip-flop provides a control signal which is applied to one input 24 of an alarm signalling circuit 26 of known design which includes an audible alarm device for sounding an alarm.

Preferably, although not necessarily, the housing 10 also contains a smoke detector 27 of known design, which may operate either on the photoelectric or the ionization chamber principle. The output of this smoke detector is connected to a second input terminal 28 of the alarm signalling circuit 26, so that the audible alarm device therein will be triggered by the detection of smoke by the smoke detector 27.

A normally-open tilt switch, such as a mercury switch 29, is mounted in the housing 10 to be closed when the housing 10 is tilted in response to the turning of the doorknob a predetermined amount (i.e., 30 degrees) from its normal position. This mercury switch is connected between a positive power supply terminal 30 and a second input terminal 31 of flip-flop 23. A thermostat 32 mounted in the housing 10 is connected in parallel with the mercury switch 29. With this arrangement, the rotation of the doorknob by an intruder will turn on the alarm, as will the closing of the switch contacts in the thermostat 32 if the temperature at the alarm housing 10 rises above a predetermined level, such as 170 degrees F. (76.7 degrees C.)

Referring to the more detailed circuit diagram shown in FIG. 3, the housing of the alarm apparatus holds a 9 volt battery 33 whose positive terminal is connected through a manually operated on/off switch 34 to the input of a voltage regulator 35, which provides a regulated 5 volts at terminal 36. The negative terminal of battery 33 is connected directly to the balancer plate 14 which provides the internal "ground" or reference potential inside the housing 10 of the alarm apparatus. All of the grounds shown in FIG. 3 are provided by the balancer plate 14.

The balancer plate 14 is connected to the regulated 5 volt terminal 36 through a capacitor 37, a parallel circuit having in one branch a rectifier 38 and in the other branch a series-connected rectifier 39 of the opposite polarity and resistor 40, and a resistor 41.

The oscillator 15 is constituted by part of an intergrated circuit chip 42 of known design. The power supply input terminal 43 of the oscillator is connected directly to the regulated 5 volt terminal 36. The output terminal 44 of the oscillator is connected via line 45 to one input terminal 46 of the exclusive OR gate 17.

The single shot 16 also is on the integrated circuit chip 42. The power supply input terminals 47 and 48 of the single shot are connected directly to the regulated 5 volt terminal 36. The output terminal 49 of the single shot is connected via line 50 to a second input terminal 51 of the exclusive OR gate 17. The sensor S and capacitor 19 are connected directly to terminals 18 and 53 of the single shot 16. Terminal 53 is connected through a potentiometer 54 to the regulated 5 volt terminal 36.

The pulse interval of the single shot 16 begins when a transistor Q1 is turned on at the beginning of each output pulse from the oscillator 15. The base of Q1 is connected through a resistor 56 to the oscillator output terminal 44. The emitter of Q1 is grounded. The collector of Q1 is connected through a resistor 57 to the regulated 5 volt terminal 36. This collector also is connected through a capacitor 58 to a terminal 59 of the single shot 16 whose potential determines the beginning of a pulse interval. A resistor 60, connected to the regulated 5 volt power supply terminal 36, and a grounded resistor 61 of the same ohmic value as resistor 60 constitute a voltage divider which normally applies 2.5 volts to the single shot terminal 59. However, when Q1 turns on, this voltage drops instantaneously to substantially zero, so that the beginning of the pulse interval of the single shot 16 will coincide substantially with the beginning of the pulse produced by the oscillator 15. The output pulse of the single shot 16 begins at the beginning of the output pulse of the oscillator 15 and terminates sooner than the oscillator pulse by a time difference t in FIG. 1*a* which depends upon the capacitance connected to its terminals 18 and 53. That capacitance, of course, depends upon whether or not a person's body capacitance is present at the sensor S.

The output pulse from the exclusive OR circuit 17 lasts for the time t and is applied to the base of a transistor Q2, which functions as a driver. The collector of Q2 is connected to the regulated 5 volt terminal 36. Its emitter is connected to ground through a resistor 62.

The emitter of the driver Q2 also is connected through a resistor 63 to the negative input terminal 64 of a differential amplifier 65 in the integrator block 20. A positive input terminal 66 of this differential amplifier is connected through a resistor 67 to the regulated 5 volt power supply terminal 36. A resistor 68 and capacitor 69 are connected in parallel with each other between the output terminal 70 of the differential amplifier 65 and its negative input terminal 64. A resistor 71 and capacitor 72 are connected in parallel with each other between the positive input terminal 66 of the differential amplifier 65 and ground.

The level detector block 21 includes a differential amplifier 73 having a positive input terminal 74 connected through a resistor 75 to the output terminal 70 of the differential amplifier 65 in the integrator block 20. The differential amplifier 73 in the level detector has a negative input terminal 76 which is connected through a resistor 77 and a potentiometer 78 to the regulated 5 volt power terminal 36. A parallel-connected resistor 79 and capacitor 80 are connected between the output terminal 81 of the differential amplifier 73 and its positive input terminal 74. A resistor 102 is connected between the output terminal 81 of the differential amplifier 73 and ground.

The flip-flop block 23 includes a pair of differential amplifiers 82 and 83. Amplifier 83 has a positive input terminal 84 which is connected to the level detector output terminal 81 through series connected resistors 85 and 86. The juncture 104 between resistors 85 and 86 is connected to ground through a resistor 105. Amplifier 83 has its output terminal 87 connected through a feedback resistor 88 to the negative input terminal 89 of the other differential amplifier 82 in the flip-flop. Amplifier 82 has its output terminal 90 connected through a resistor 91 to the negative input terminal 92 of differential amplifier 83. A capacitor 93 is connected between this input terminal 92 and ground.

The positive input terminal 84 of amplifier 83 is connected through a resistor 94 to the mercury switch 29 and the thermostat switch 32, so that the closing of either of these switches will set the flip-flop 23, as will a positive signal from the level detector output terminal 81 (via resistors 85 and 86). In FIG. 3, the upper terminals of the mercury switch 29 and the thermostat switch 32 are connected to the power supply at terminal 30. A capacitor 103 is connected between the lower contacts of these switches and ground. Resistor 94 also is connected to the lower contacts of these switches.

The differential amplifier 82 in flip-flop 23 has a positive input terminal 95, which is connected through a resistor 96 to a normally-open reset switch 97. When this switch is closed manually it applies a positive voltage to terminal 95 to reset flip-flop 23. A resistor 98 is connected between input terminal 95 and ground.

The output terminal 87 of the second differential amplifier 83 in flip-flop 23 is the output terminal of the flip-flop. It is connected through a resistor 99 to the gate of a transistor Q3, which functions as a driver. The emitter of Q3 is grounded. Its collector is connected to the alarm signalling circuit 26 such that when Q3 is turned on an audible alarm signalling device is energized in the alarm signalling circuit 26, thus sounding an alarm.

The alarm signalling circuit has a power supply input terminal 100 which is connected to the regulated 5 volt power supply terminal 36. Also, the alarm signalling circuit has a signal input terminal 101 connected to receive an output signal from the smoke detector 27 to turn on the audible alarm signalling device when detector 27 senses smoke.

A manually operated selector switch 106 is connected between ground and the juncture 104 between resistors 85 and 86. When the door is of wood or other electrically non-conductive material, switch 106 will be open. However, when the door is of metal, the level detector 21 can be disabled by closing switch 106, which leaves the alarm signalling circuit 26 able to operate in response to the closing of the mercury switch 29 on the doorknob, or the thermostat switch 32, or the smoke detector 27.

When switch 106 is open, the body capacitance of a person touching or closely approaching the outside doorknob will be effectively added to the fixed capacitance 19 connected to terminal 18 of the single shot 16. As a consequence, the width of the output pulses from the single shot will increase, causing a corresponding decrease in the width of the output pulses from the exclusive OR circuit 17. In turn, this reduces the magnitude of the output signal from the integrator 20 causing a greater difference between the respective input signals to the level detector 21 at the latter's input terminals 76 and 74. Consequently, the signal at the level detector output terminal 81 increases, applying a "set" signal to the flip-flop 23 to trigger the alarm signalling circuit 26.

With this circuit arrangement, the capacitance change which occurs when a person touches the doorknob can be detected using a relatively low frequency oscillator (e.g., 100 kHz.) which can be provided on an integrated circuit chip without any inductors.

When switch 106 is closed, as it should be when the alarm apparatus is used on a metal door, the level detector 21 will be disabled from operating the flip-flop 23 because the output terminal 81 of the level detector now is grounded. Consequently, the body capacitance of a person touching the doorknob will not cause the alarm signalling device in circuit 26 to operate. However, the mercury switch 29 will still be effective to control the flip-flop 23, such that the would-be intruder's partial rotation of the doorknob will close the mercury switch, causing the alarm to be sounded.

I claim:

1. In an intrusion alarm apparatus having an oscillator producing a first series of output pulses at a predetermined frequency, the improvement which comprises:

means for producing a second series of output pulses synchronized with the output pulses of said first series and of shorter duration than the latter;

means responsive to said first and second series of output pulses for producing a control signal representing the difference in duration between the pulses of said first and second series;

a sensor operatively arranged to change the duration of the pulses of said second series and thereby change said control signal in response to the body capacitance of a person touching said sensor;

and an alarm signalling circuit operable by said control signal to signal an alarm when a person touches said sensor.

2. An intrusion alarm apparatus according to claim 1, wherein said oscillator operates at a frequency of substantially 100 kHz.

3. In an intrusion alarm apparatus having an oscillator producing output pulses at a predetermined frequency, the improvement which comprises:

a single shot operating in synchronism with said oscillator and producing narrower output pulses than said oscillator;

means operatively coupled to the outputs of said oscillator and said single shot for producing a control signal representing the difference in width between the oscillator and single shot output pulses;

a sensor operatively coupled to said single shot for changing the width of its output pulses to thereby change said control signal in response to the body capacitance of a person touching said sensor;

and an alarm signalling circuit operatively connected to receive said control signal and including means for signalling an alarm in response to a change in said control signal caused by a person touching said sensor.

4. An intrusion alarm apparatus according to claim 3, and further comprising:

a fixed capacitor operatively connected to said single shot to determine the width of the output pulses from the single shot in the absence of a person touching said sensor;

said sensor being operatively connected to said single shot to add the body capacitance of a person touching the sensor to the capacitance of said fixed capacitor.

5. An intrusion alarm apparatus according to claim 4, and further comprising:

a broad area, electrically conductive balancer plate providing a reference potential for said oscillator;

said fixed capacitor being connected between said single shot and said balancer plate.

6. An intrusion alarm apparatus according to claim 5, wherein said sensor is operatively arranged to increase the width of the output pulses from the single shot in response to the body capacitance of a person touching the doorknob.

7. An intrusion alarm apparatus according to claim 3, wherein said sensor is operatively arranged to increase the width of the output pulses from the single shot in response to the body capacitance of a person touching the doorknob.

8. An intrusion alarm apparatus according to claim 6, wherein said means for producing a control signal comprises:

an exclusive OR circuit having input terminals connected respectively to the outputs of said oscillator and said single shot;

an integrator operatively connected to the output of said exclusive OR circuit;

a level detector operatively connected to the output of said integrator;

and a flip-flop operatively coupled to the output of said level detector to trigger said alarm signalling means in response to a change in the output from said level detector caused by the body capacitance of a person touching said sensor.

9. An intrusion alarm apparatus according to claim 8, wherein said sensor includes a doorknob on a door, and said intrusion alarm apparatus further comprises:

a tilt switch operable by the turning of said doorknob and operatively coupled to said flip-flop to cause the latter to trigger said alarm signalling means when the doorknob is turned.

10. An intrusion alarm apparatus according to claim 9, and further comprising:

a selector switch operably connected to said level detector to selectively disable the latter and thereby prevent said alarm signalling circuit from responding to said sensor.

11. An intrusion alarm apparatus according to claim 10, and further comprising:

a thermostat operatively coupled to said flip-flop to cause the latter to trigger said alarm signalling means when the temperature at said alarm apparatus exceeds a predetermined level.

12. An intrusion alarm apparatus according to claim 11, and further comprising:

a smoke detector operatively connected to said alarm signalling circuit to trigger said alarm signalling means in response to the detection of smoke by said smoke detector.

13. An intrusion alarm apparatus according to claim 9, and further comprising:

a thermostat operatively coupled to said flip-flop to cause the latter to trigger said alarm signalling means when the temperature at said alarm apparatus exceeds a predetermined level.

14. An intrusion alarm apparatus according to claim 9, and further comprising:

a smoke detector operatively connected to said alarm signalling circuit to trigger said alarm signalling means in response to the detection of smoke by said smoke detector.

15. An intrusion alarm apparatus according to claim 3, wherein said means for producing a control signal comprises:

an exclusive OR circuit having input terminals connected respectively to the outputs of said oscillator and said single shot;

an integrator operatively connected to the output of said exclusive OR circuit;

a level detector operatively connected to the output of said integrator;

and a flip-flop operatively coupled to the output of said level detector to trigger said alarm signalling means in response to a change in the output from said level detector caused by the body capacitance of a person touching said sensor.

16. An intrusion alarm apparatus according to claim 15, wherein said sensor includes a doorknob on a door, and said intrusion alarm apparatus further comprises:

a tilt switch operable by the turning of said doorknob, said tilt switch being operatively coupled to said flip-flop to cause the latter to trigger said alarm signalling means when the doorknob is turned.

17. An intrusion alarm apparatus according to claim 16, and further comprising:

a selector switch operatively connected to said level detector to selectively disable the latter and thereby prevent said alarm signalling circuit from responding to said sensor.

18. An intrusion alarm apparatus according to claim 15, and further comprising:

a thermostat operatively coupled to said alarm signalling circuit to trigger said alarm signalling means when the temperature at said alarm apparatus exceeds a predetermined level.

19. An intrusion alarm apparatus according to claim 15, and further comprising:

a smoke detector operatively connected to said alarm signalling circuit to trigger said alarm signalling means in response to the detection of smoke by said smoke detector.

* * * * *